US012729915B2

(12) United States Patent
Onaka et al.

(10) Patent No.: US 12,729,915 B2
(45) Date of Patent: Sep. 8, 2026

(54) HEAT EXCHANGER AND REFRIGERATION CYCLE APPARATUS

(71) Applicant: Mitsubishi Electric Corporation, Tokyo (JP)

(72) Inventors: Yoji Onaka, Tokyo (JP); Rihito Adachi, Tokyo (JP); Nanami Kishida, Tokyo (JP); Tetsuji Saikusa, Tokyo (JP); Yohei Kato, Tokyo (JP); Atsushi Kibe, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 40 days.

(21) Appl. No.: 18/854,088

(22) PCT Filed: Apr. 12, 2022

(86) PCT No.: PCT/JP2022/017586
§ 371 (c)(1),
(2) Date: Oct. 4, 2024

(87) PCT Pub. No.: WO2023/199400
PCT Pub. Date: Oct. 19, 2023

(65) Prior Publication Data

US 2025/0237439 A1 Jul. 24, 2025

(51) Int. Cl.
*F28D 1/053* (2006.01)
*F28F 1/12* (2006.01)
*F28F 17/00* (2006.01)

(52) U.S. Cl.
CPC ..... *F28D 1/05366* (2013.01); *F28F 1/128* (2013.01); *F28F 17/005* (2013.01);
(Continued)

(58) Field of Classification Search
CPC ..... F28D 1/05366; F28F 1/128; F28F 17/005; F28F 2265/06; F28F 2265/22; F28F 2275/04
(Continued)

(56) References Cited

U.S. PATENT DOCUMENTS 5,033,540 A * 7/1991 Tategami ..... F28F 1/128 165/41
5,062,475 A * 11/1991 Bemisderfer ..... F28F 1/34 165/181
(Continued)

FOREIGN PATENT DOCUMENTS

CN 107208982 B * 6/2019 ..... F28F 1/128
EP 3173725 A1 5/2017
(Continued)

OTHER PUBLICATIONS

International Search Report and Written Opinion mailed on Jul. 5, 2022, received for International Application No. PCT/JP2022/017586, filed on Apr. 12, 2022, 13 pages including English Translation.
(Continued)

*Primary Examiner* — Jon T. Schermerhorn, Jr.
(74) *Attorney, Agent, or Firm* — XSENSUS LLP

(57) ABSTRACT

A heat exchanger includes a plurality of heat exchange modules. Each of the plurality of heat exchange modules includes a pair of headers, a plurality of flat heat-transfer tubes, and a plurality of corrugated fins. The plurality of corrugated fins each have a corrugated shape and are each placed between ones of the flat heat-transfer tubes that face each other. The corrugated shape has apices joined to the flat heat-transfer tubes. The plurality of corrugated fins each include fin modules between the a pieces. The fin modules are arranged in the up-down direction. One of the corrugated fins situated on a leeward side in the direction of flow of the
(Continued)

air is higher in outside-tube heat transfer coefficient than is one of the corrugated fins situated on a windward side in the direction of flow of the air.

15 Claims, 15 Drawing Sheets

(52) U.S. Cl.
CPC ..... *F28F 2265/06* (2013.01); *F28F 2265/22* (2013.01); *F28F 2275/04* (2013.01)

(58) Field of Classification Search
USPC ..... 165/181
See application file for complete search history.

(56) References Cited

U.S. PATENT DOCUMENTS 5,086,835 A * 2/1992 Shinmura ..... F28F 9/0246 123/41.51
5,743,328 A * 4/1998 Sasaki ..... F28D 1/05391 165/146
5,975,200 A * 11/1999 Kato ..... F28F 1/325 165/181
5,992,514 A * 11/1999 Sugimoto ..... F28F 9/001 165/149
6,170,565 B1 * 1/2001 Nishishita ..... F28D 1/0435 165/146
6,209,628 B1 * 4/2001 Sugimoto ..... F28F 1/128 165/146
6,213,196 B1 * 4/2001 Ozaki ..... F28D 1/0435 165/135
6,354,368 B1 * 3/2002 Nishishita ..... F28D 1/0435 165/135
6,357,518 B1 * 3/2002 Sugimoto ..... F28D 1/0435 165/135
6,561,264 B2 * 5/2003 Ozaki ..... F28D 1/0435 165/135
6,662,861 B2 * 12/2003 Ozaki ..... F28F 1/128 165/135
6,889,757 B2 * 5/2005 Iwasaki ..... F28F 1/128 165/135
8,196,646 B2 * 6/2012 Huang ..... F28F 1/128 165/135
10,584,921 B2 * 3/2020 Steinbach ..... B21D 53/085
10,739,076 B2 * 8/2020 Liang ..... F28D 1/05366
10,760,824 B2 * 9/2020 Akaiwa ..... F28F 1/128
10,775,081 B2 * 9/2020 Akaiwa ..... F25D 17/067
11,009,300 B2 * 5/2021 Matsumoto ..... F28D 1/05325
11,073,342 B2 * 7/2021 Yamada ..... F28F 1/32
2001/0035284 A1 11/2001 Iwasaki et al.
2003/0075307 A1 * 4/2003 Stoynoff ..... F28F 1/126 165/135
2007/0199686 A1 8/2007 Okinotani et al.
2008/0202153 A1 * 8/2008 Watanabe ..... F28F 17/005 165/153
2009/0301696 A1 * 12/2009 Iwasaki ..... F28D 1/0435 165/140
2010/0175863 A1 7/2010 Denoual
2010/0254081 A1 10/2010 Koenig et al.
2013/0240186 A1 9/2013 Taras et al.
2017/0082381 A1 3/2017 Sugimura et al.
2024/0085122 A1 3/2024 Onaka et al.

FOREIGN PATENT DOCUMENTS

GB 2563169 A * 12/2018 ..... F28F 1/022
JP S58-066287 U 5/1983
JP S62-009197 A 1/1987
JP H06-147785 A 5/1994
JP H06-221787 A 8/1994
JP 2003-083691 A 3/2003
JP 2004-271113 A 9/2004
JP 2007-232246 A 9/2007
JP 2009-085464 A 4/2009
JP 2009-150621 A 7/2009
JP 2010-181140 A 8/2010
JP 2010-532859 A 10/2010
JP 2015-183908 A 10/2015
WO 2004/102102 A1 11/2004
WO 2016/013100 A1 1/2016
WO 2021/095087 A1 5/2021

OTHER PUBLICATIONS

Extended European Search Report issued Apr. 11, 2025 in European Patent Application No. 22937380.8, 8 pages.
Office Action dated May 22, 2026 issued in corresponding European patent application No. 22937380.8 (5 pages).

* cited by examiner

HEAT EXCHANGER AND REFRIGERATION CYCLE APPARATUS

CROSS-REFERENCE TO RELATED APPLICATION

This application is a national stage application, pursuant to 35 U.S.C. § 371, of International Patent Application No. PCT/JP2022/017586, filed Apr. 12, 2022, the entire contents of which are incorporated herein by reference.

TECHNICAL FIELD

The present disclosure relates to heat exchangers and refrigeration cycle apparatuses and, in particular, to a heat exchanger constituted by a combination of corrugated fins and flat heat-transfer tubes and to a refrigeration cycle apparatus.

BACKGROUND ART

There is widespread use of corrugated fin tube heat exchangers. One such available corrugated fin tube heat exchanger has a corrugated fin placed between flat-surface portions of a plurality of flat heat-transfer tubes connected between a pair of headers through which refrigerant passes. A corrugated fin is placed between flat heat-transfer tubes, and gas such as air passes as an airflow. In such a heat exchanger, when surface temperature of at least either a flat heat-transfer tube or a corrugated fin drops, moisture is generated in air near the surface and precipitated into condensed water. Thus formed water freezes at or below the freezing point of water, depending on conditions in which the heat exchanger is used. To address the frosting, a heat exchanger is configured to drain water precipitated on the surface via a slit provided as a void in a portion supposed to be a part of a fin (see, for example, Patent Literature 1).

Further, for example, when a heat exchanger is used in an outdoor unit of an air-conditioning apparatus, refrigerant flowing through a flat heat-transfer tube evaporates by taking away heat from air passing through a corrugated fin, and the air is cooled by the removal of heat. Then, moisture retained by the air condenses on the surface of the corrugated fin and thereby causes closure of air passage through which the air passes. In particular, when the corrugated fin has a louver, outside-tube heat transfer coefficient increases near the louver. This accelerates the formation of frost on the heat exchanger, and the frost grows to close the air passage. In particular, on the windward side of the corrugated fin, there is a great temperature difference between the air and the fin surface. This causes more frost formation on the windward side of the corrugated fin that disproportionally large amount of frost is formed on the leading edge, resulting in air passage closure in a short operating time period. To address this problem, a heat exchanger is configured such that a louver is provided not on the windward side but on the leeward side of a corrugated fin (see, for example, Patent Literature 2).

CITATION LIST

Patent Literature

Patent Literature 1: Japanese Unexamined Patent Application Publication No. 2015-183908

Patent Literature 2: Japanese Unexamined Patent Application Publication No. 6-221787

SUMMARY OF INVENTION

Technical Problem

The heat exchanger of Patent Literature 1 has a drain slit through which condensed water on the fin surface is drained; however, enlarging an opening portion of the drain slit to improve drainage performance invites a decrease in heat-transfer performance due to a decrease in heat-transfer area while bringing about improvement in drainage performance. Further, providing a louverless portion on the windward side of a corrugated fin as in the case of the heat exchanger of Patent Literature 2 makes it impossible to sufficiently drain condensed water, although doing so makes it possible to reduce the formation of a disproportionately large amount of frost on a windward portion. Further, in the heat exchanger of Patent Literature 2, an upper pattern of louvers and a lower pattern of louvers are opposite to each other. For this reason, such a pattern of fins is formed for some louvers that frost easily forms on the windward side. Accordingly, the heat exchanger of Patent Literature 2 has a possibility that an air way may be closed by a disproportionately large amount of frost forming on a louver of a fin, formed in the windward portion, on which frost easily forms, and has a problem with a decrease in heating capacity (heating low-temperature capacity) under low-temperature conditions.

To address the foregoing problems, the present disclosure has as an object to provide a heat exchanger and a refrigeration cycle apparatus with improved drainage performance and with reduced likelihood of a disproportionately large amount of frost forming on a louver.

Solution to Problem

A heat exchanger according to an embodiment of the present disclosure includes a plurality of heat exchange modules arranged with spacing from one another along a direction of flow of air. Each of the plurality of heat exchange modules includes a pair of headers through which a fluid passes, a plurality of flat heat-transfer tubes, and a plurality of corrugated fins. The two headers are placed at a distance from each other in an up-down direction. The plurality of flat heat-transfer tubes each have a flat shape in cross-section, are placed between the two headers such that a flat surface of a long side of the flat shape of each of the flat heat-transfer tubes and a flat surface of a long side of the flat shape of an other of the flat heat-transfer tubes face each other with spacing from one another, and each have therein flow passages through which the fluid flows. The plurality of corrugated fins each have a corrugated shape and are each placed between ones of the flat heat-transfer tubes that face each other. The corrugated shape has apices joined to the flat heat-transfer tubes. The plurality of corrugated fins each include fin modules between the a pieces. The fin modules are arranged in the up-down direction. One of the corrugated fins situated on a leeward side in the direction of flow of the air is higher in outside-tube heat transfer coefficient than is one of the corrugated fins situated on a windward side in the direction of flow of the air.

Further, a refrigeration cycle apparatus according to an embodiment of the present disclosure includes the heat exchanger.

Advantageous Effects of Invention

A heat exchanger according to an embodiment of the present disclosure is a corrugated fin heat exchanger formed by a plurality of heat exchange modules in which the outside-tube heat transfer coefficient of a corrugated fin situated on a leeward side in a direction of flow of air is higher than the outside-tube heat transfer coefficient of a corrugated fin situated on a windward side in the direction of flow of the air. This prevents closure of an air way in the windward corrugated fin, making it possible to steer toward uniformity the amount of frost that forms on the whole heat exchanger. This makes it possible to increase the length of time it takes for an air way in the heat exchanger to be completely closed by frost, and the heat exchanger can have improved heating low-temperature capacity.

DESCRIPTION OF EMBODIMENTS

Figure 1:
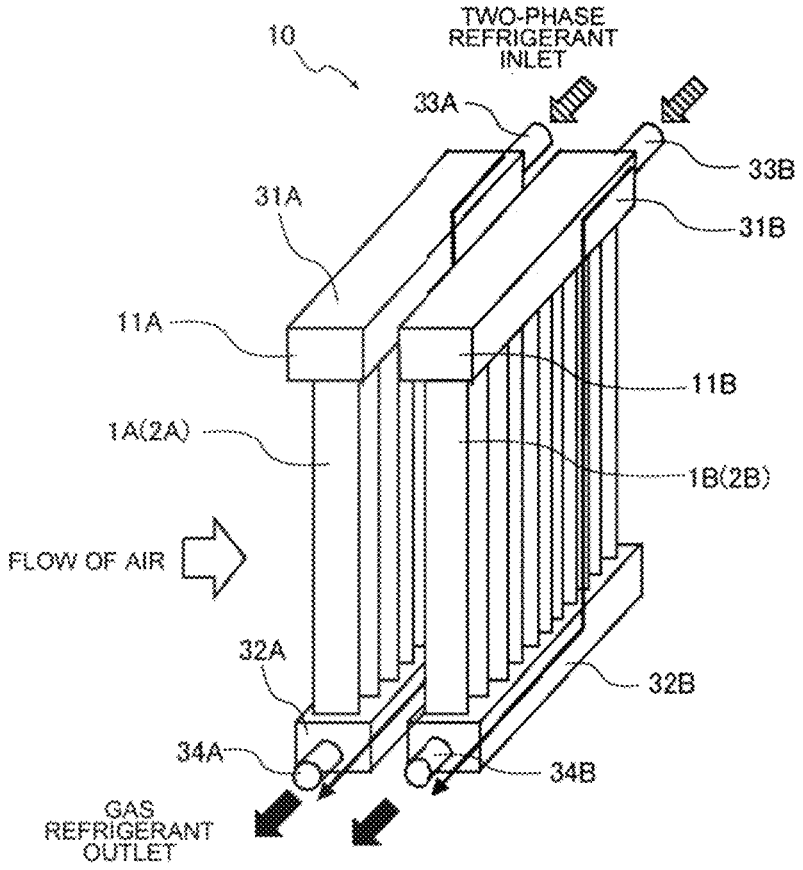
FIG. 1 is a schematic view illustrating a configuration of a heat exchanger according to Embodiment 1.

In the following, heat exchangers and a refrigeration cycle apparatus according to embodiments are described, for example, with reference to the accompanying drawings. Further, constituent elements given identical signs in the following drawings are identical or equivalent to each other, and these signs are adhered to throughout the full text of the embodiments described below. Moreover, the forms of constituent elements expressed in the full text of the specification are merely examples and are not limited to forms described herein. In particular, a combination of constituent elements is not limited solely to a combination in one embodiment, but constituent elements described in another embodiment can be applied to still another embodiment. Further, the following description assumes that an upper part of a drawing is an "upper side", and a lower part of a drawing as a "lower side". Furthermore, directive terms (such as "right" and "left") used to promote understanding are intended for descriptive purposes and are not intended to limit the present disclosure. Further, how high or low temperatures and humidities are is not determined in relation to particularly absolute values but relatively determined according to states, actions, or other conditions in apparatuses or other devices. Moreover, relationships in size between one constituent element and another in the drawings may be different from actual ones.

Embodiment 1

FIG. 1 is a schematic view illustrating a configuration of a heat exchanger according to Embodiment 1. The heat exchanger 10 of Embodiment 1 includes a plurality of parallel-pipe corrugated-fin-tube-type heat exchange modules 11. In this example, as shown in FIG. 1, the heat exchanger 10 includes a windward heat exchange module 11A situated on the windward side (upstream) in the flow of air and a leeward heat exchange module 11B situated on the leeward side (downstream). Further, the heat exchanger 10 includes a plurality of flat heat-transfer tubes 1, a plurality of corrugated fins 2, and a plurality of headers 3. In the heat exchanger 10, the windward heat exchange module 11A includes flat heat-transfer tubes 1A, corrugated fins 2A, and headers 3A. Further, the leeward heat exchange module 11B includes flat heat-transfer tubes 1B, corrugated fins 2B, and headers 3B.

The headers 3 are each a tube that is connected by pipes to other devices that constitute a refrigeration cycle apparatus, into and out of which refrigerant flows, and that causes the refrigerant to bifurcate or merge. The refrigerant is a fluid that serves as a heat exchange medium. The windward heat exchange module 11A includes an upper header 31A and a lower header 32A, and the upper header 31A and the lower header 32A are placed with spacing from one another in an up-down direction of FIG. 1. Further, the leeward heat exchange module 11B includes an upper header 31B and a lower header 32B, and the upper header 31B and the lower header 32B are placed with spacing from one another in the up-down direction of FIG. 1.

Between an upper header 31 and a lower header 32, a plurality of flat heat-transfer tubes 1 are placed perpendicularly to the upper header 31 and the lower header 32. Between the upper header 31A and the lower header 32A, a plurality of flat heat-transfer tubes 1A are placed. Further, between the upper header 31B and the lower header 32B, a plurality of flat heat-transfer tubes 1B are placed. The plurality of flat heat-transfer tubes 1 are placed parallel to one another. The plurality of flat heat-transfer tubes 1 are placed side by side at equal spacings in a direction orthogonal to a direction of flow of the air. In the following, the direction in which the flat heat-transfer tubes 1 are placed side by side is referred to as "tube side-by-side placement direction". Further, the axial direction (up-down direction in FIG. 1) of the flat heat-transfer tubes 1 is referred to as "tube axial direction".

Each of the flat heat-transfer tubes 1 has a flat shape in cross-section. Each of the flat heat-transfer tubes 1 is such a heat-transfer tube that an outer surface (hereinafter referred to as "flat surface") of a long side of the flat cross-section has the shape of a planar surface and an outer surface of a short side of the flat cross-section has the shape of a curved surface. Each of the flat heat-transfer tubes 1 is a multi-hole heat-transfer tube having a plurality of refrigerant flow passages formed by through holes inside the tube. Each of the flat heat-transfer tubes 1 is disposed to stand in the tube axial direction, has its through holes extending in the tube axial direction, and communicates with the upper header 31 and the lower header 32. Each of the flat heat-transfer tubes 1 is placed so that a long side of the flat cross-section extends along the direction of flow of the air. Each flat heat-transfer tube 1 is joined to the upper header 31 and the lower header 32 by having both ends inserted in and brazed to insertion holes (not illustrated) formed separately in each of the headers 3. A usable example of a brazing filler metal is an aluminum-containing brazing filler metal. Note here that in a case in which the heat exchanger 10 is used as an evaporator, low-temperature and low-pressure refrigerant flows through the refrigerant flow passages inside the flat heat-transfer tubes 1. In a case in which the heat exchanger 10 is used as a condenser, high-temperature and high-pressure refrigerant flows through the refrigerant flow passages inside the flat heat-transfer tubes 1. The arrows in FIG. 1 indicate the flow of refrigerant in a case in which the heat exchanger 10 is used as an evaporator. Embodiment 1 is intended to describe the formation of frost on fin surfaces in a case in which the heat exchanger 10 is used as an evaporator.

As indicated by the arrows in FIG. 1, the refrigerant flows into the upper headers 31A and 31B via inflow pipes 33 (inflow pipes 33A and 33B) through which the refrigerant is supplied from an external device (not illustrated) to the heat exchanger 10. The refrigerant flowing into the upper headers 31A and 31B is distributed and passes through each flat heat-transfer tube 1. Note here that the inflow pipes 33 are pipes through which the refrigerant flows in when the heat exchanger 10 serves as an evaporator. Depending on the flow of the refrigerant in the refrigeration cycle apparatus, the inflow pipes 33 may be pipes through which the refrigerant flows out. The flat heat-transfer tubes 1 exchanges heat between the refrigerant passing through inside the tubes and outside air that is external atmospheric air passing through outside the tubes. At this point in time, the refrigerant removes heat from the atmospheric air while passing through the flat heat-transfer tubes 1. The refrigerant subjected to heat exchange through each flat heat-transfer tube 1 flows into the lower headers 32A and 32B and merges inside the lower headers 32A and 32B. The refrigerant merging inside the lower headers 32A and 32B is refluxed to the external device (not illustrated) through pipes (outflow pipes 34A and 34B) connected to the lower headers 32A and 32B. Note here that the outflow pipes 34 are pipes through which the refrigerant flows out when the heat exchanger 10 serves as an evaporator. Depending on the flow of the refrigerant in the refrigeration cycle apparatus, the outflow pipes 34 may be pipes through which the refrigerant flows in. Each of the corrugated fins 2 is placed between adjacent ones of the flat heat-transfer tubes 1. The corrugated fins 2 are disposed to expand the area of heat transfer between the refrigerant and the outside air.

Figure 2:
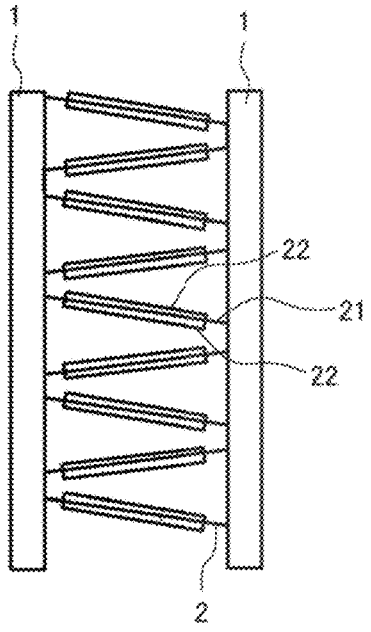
FIG. 2 is a schematic front view of part of the heat exchanger according to Embodiment 1.

FIG. 2 is a schematic front view of part of the heat exchanger according to Embodiment 1. Each of the corrugated fins 2 is formed in a pleated corrugated shape by a flat-plate fin material being subjected to corrugating and bent into a zigzag pattern with repeated mountain folds and valley folds. Note here that bent portions based on undulations formed in a corrugated shape (mountain and valley shape) serve as apices of the corrugated shape. Further, a mid-slope is placed between each of the apices and the other. In Embodiment 1, the apices of the corrugated fin 2 are arranged in the tube axial direction.

Each apex of the corrugated fin 2 is joined to a flat surface of a flat heat-transfer tube 1. These junctions are brazed and joined by brazing filler metal. The corrugated fin 2 is constituted by a fin material such as an aluminum alloy. Moreover, the fin material by which the corrugated fin 2 is constituted has a surface cladded with a brazing filler metal layer. The clad brazing filler metal layer is made mainly of, for example, brazing filler metal containing aluminum-silicon aluminum. Note here that the thickness of the fin material by which the corrugated fin 2 is constituted ranges, for example, from approximately 50 μm to approximately 200 μm. The corrugated fin 2 is configured such that plate-like fin materials are joined together one after another in a corrugated shape in the tube axial direction. The corrugated fin 2 is shaped such that fin modules 21 serving as mid-slopes of the corrugated shape are joined together one after another in the tube axial direction at alternately reversed inclinations when seen from the direction of flow of the air (i.e. a direction parallel with a depth from a paper surface in FIG. 2). Each of the fin modules 21 has formed therein a plurality of louvers 22 arranged in the direction of flow of the air (i.e. a direction parallel with a depth from a paper surface). Note here that each of the louvers 22 has a plate portion and an opening. The plate portion is shaped to protrude at an inclination in the up-down direction relative to a flat portion when the corrugated fin 2 is seen in a front view from the direction of flow of the air. The plate portion guides the air to the opening, and changes the flow of the air by causing the air to pass through the opening. In the fin module 21, the larger the sum of the areas of portions protruding as the louvers 22 relative to the flat portion when the corrugated fin 2 is seen in a front view from the direction of flow of the air becomes, the higher the outside-tube heat transfer coefficient aO becomes.

A magnitude relationship in outside-tube heat transfer coefficient aO between two corrugated fins 2 is described here. For example, liquid such as hot water at a given temperature (e.g. 50 degrees C.) is passed through flat heat-transfer tubes 1 joined to the intended corrugated fins 2. Then, a comparison in outside-tube heat transfer coefficient aO between the two corrugated fins 2 is made by the temperature of the liquid that flows out from the flat heat-transfer tubes 1 when air-cooled at a given room temperature (e.g. 20 degrees C.) and by the same amount of air. One of the corrugated fins 2 that is lower in temperature of the liquid that flows out from the flat heat-transfer tubes 1 exchanges more heat with air and therefore is higher in outside-tube heat transfer coefficient aO than the other of the corrugated fins 2. The heat exchanger 10 according to Embodiment 1 is structured to specifications of the louvers 22 such that a windward corrugated fin 2A is lower in outside-tube heat transfer coefficient aO than a leeward corrugated fin 2B. Examples of the specifications of the louvers 22 include the louver width of a louver 22, the angle of a louver 22, the pitch between louvers 22, and the number of louvers 22.

Figure 3:
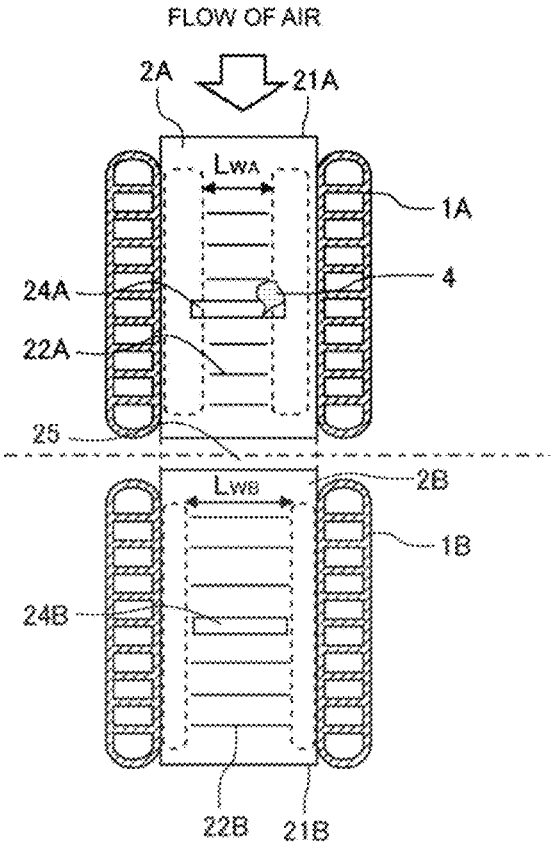
FIG. 3 is a schematic front view of part of the heat exchanger according to Embodiment 1.

FIG. 3 is a schematic front view of part of the heat exchanger according to Embodiment 1. FIG. 3 is a top view of part of the heat exchanger 10 as taken along the direction of flow of the air. In an example shown here of the case of a corrugated fin 2A of the windward heat exchange module 11A and a corrugated fin 2B of the leeward heat exchange module 11B, the windward heat exchange module 11A is lower in outside-tube heat transfer coefficient aO than the leeward heat exchange module 11B. In heat exchanger 10 shown in FIG. 3, the louver width $L_{WA}$ of a louver 22A in the windward corrugated fin 2A is shorter than the louver width $L_{WB}$ of a louver 22B in the leeward corrugated fin 2B.

As shown in FIG. 3, the heat exchanger 10 of Embodiment 1 is configured such that the louver width $L_{WA}$ of a louver 22A in the windward corrugated fin 2A is short. For this reason, the area of a flat portion of the corrugated fin 2A in which the outside-tube heat transfer coefficient aO is low is large near a flat heat-transfer tube 1. As a result of this, the windward corrugated fin 2A has a large low frost formation region where frost hardly forms. Accordingly, for example, in a case in which the heat exchanger 10 is used under conditions where the fin surfaces are at or below the freezing point of water, a lot of air flows over the low frost formation region of the corrugated fin 2A, so that there are a decrease in the amount of frost that forms on the corrugated fin 2A and an increase n the amount of frost that forms on the leeward corrugated fin 2B. Thus, by being configured such that the lengths of the louver width $L_{WA}$ of the corrugated fin 2A and the louver width $L_{WB}$ of a louver 22B are adjusted, the heat exchanger 10 according to Embodiment 1 can steer toward uniformity the amount of frost that forms on the whole heat exchanger 10. This makes it possible to increase the length of time it takes for an air way in the heat exchanger 10 to be completely closed by frost. Accordingly, the heat exchanger 10 can have improved heating low-temperature capacity.

Further, as shown in FIG. 3, the windward corrugated fin 2A and the leeward corrugated fin 2B have louvers 22A and louvers 22B, respectively, relative to the direction of flow of the air. Moreover, in the direction of flow of the air, the fin modules 21 of the corrugated fins 2 have drain slits 24 (drain slits 24A and 24B) provided near the centers thereof in such a manner as to be interposed between louvers 22. By thus providing a drain slit 24 near the center of a fin module 21 of a corrugated fin 2, condensed water 4 forming on a surface of the fin module 21 can be quickly removed. For this reason, in a case in which the heat exchanger 10 is used as an evaporator, the condensed water 4 does not stay on the fin module 21. This makes it possible to reduce an increase in air passage resistance, thus making it possible to improve heat-exchange capability. Furthermore, this makes it possible to quickly drain frost meltwater through the drain slit 24 in performing, during heating low-temperature operation, a defrosting operation of melting frost forming on the fin surface. This makes it possible to shorten the duration of defrosting operation time, making it possible to improve heating low-temperature capacity.

Figure 4:
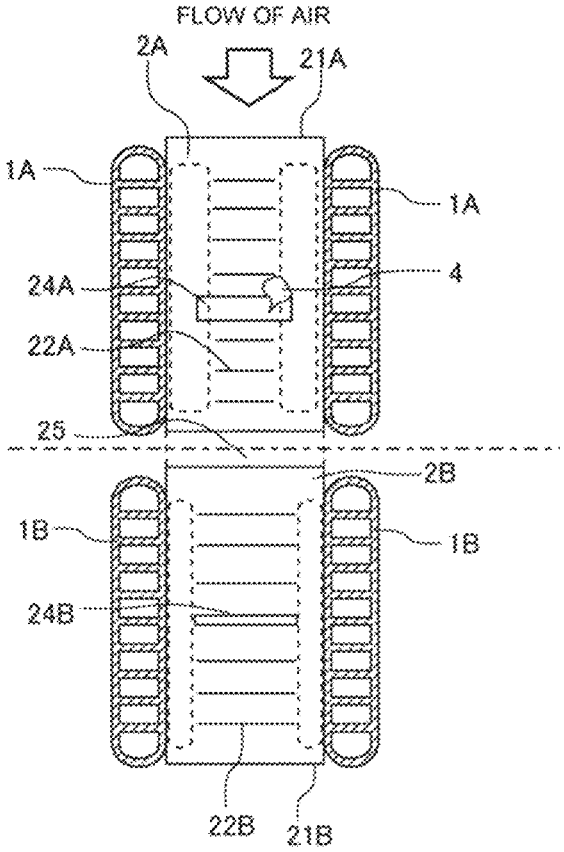
FIG. 4 is a diagram illustrating drain slits of fin modules of the heat exchanger according to Embodiment 1.

FIG. 4 is a diagram illustrating drain slits of fin modules of the heat exchanger according to Embodiment 1. Since, in the heat exchanger 10, the air starts to exchange heat with the refrigerant from the windward side, the temperature difference between the air and the refrigerant is great in the windward heat exchange module 11A. As a result of this, the amount of condensed water 4 that forms on the fin surface of the corrugated fin 2A of the windward heat exchange module 11A is larger than the amount of condensed water 4 that forms on the fin surface of the corrugated fin 2B of the leeward heat exchange module 11B. To address this problem, as shown in FIG. 4, the heat exchanger 10 according to Embodiment 1 is configured such that the opening area of the drain slit 24A in the windward corrugated fin 2A is larger than the opening area of the drain slit 24B in the leeward corrugated fin 2B. Accordingly, the opening area of the drain slit 24B is smaller than the opening area of the drain slit 24A. As a result this, the heat exchanger 10 according to Embodiment 1 can be expected to have improved drainage performance (amount of condensed water that is drained per unit time). This makes it possible to shorten the duration of defrosting operation time, making it possible to further improve heating low-temperature capacity. Although the corrugated fin 2B has been described here as having the drain slit 24B, the drain slit 24B of the corrugated fin 2B may be omitted.

Further, as shown in FIGS. 3 and 4, the heat exchanger 10 according to Embodiment 1 is configured such that the corrugated fin 2A of the windward heat exchange module 11A and the corrugated fin 2B of the leeward heat exchange module 11B are not coupled to each other but spaced at a gap from each other. The gap between the heat exchange modules 11 serves as a drain space 25. Note here that the opening area of the drain space 25 in a top view of the corrugated fins 2 is defined as A2. Further, the fin area of the fin modules 21 in a top view of the corrugated fins 2 is defined as A1. As a result of an experiment and an analysis conducted by the inventors, it was confirmed that it is preferable that the drain space 25 have such an opening area A2 that the area ratio A2/A1 is a relationship that falls within the range of 0.03 to 0.40 ($0.03 \leq A2/A \leq 0.40$). When the drain space 25 has such an opening area A2 as to satisfy such a relationship, a stream of condensed water 4 on the windward corrugated fin 2A and a stream of condensed water 4 on the leeward corrugated fin 2B merge between a lowermost stream end of the windward corrugated fin 2A and an uppermost stream end of the leeward corrugated fin 2B and flow down through the gap. For this reason, the heat exchanger 10 according to Embodiment 1 allows the drain space 25 to function as a drain path.

Figure 5:
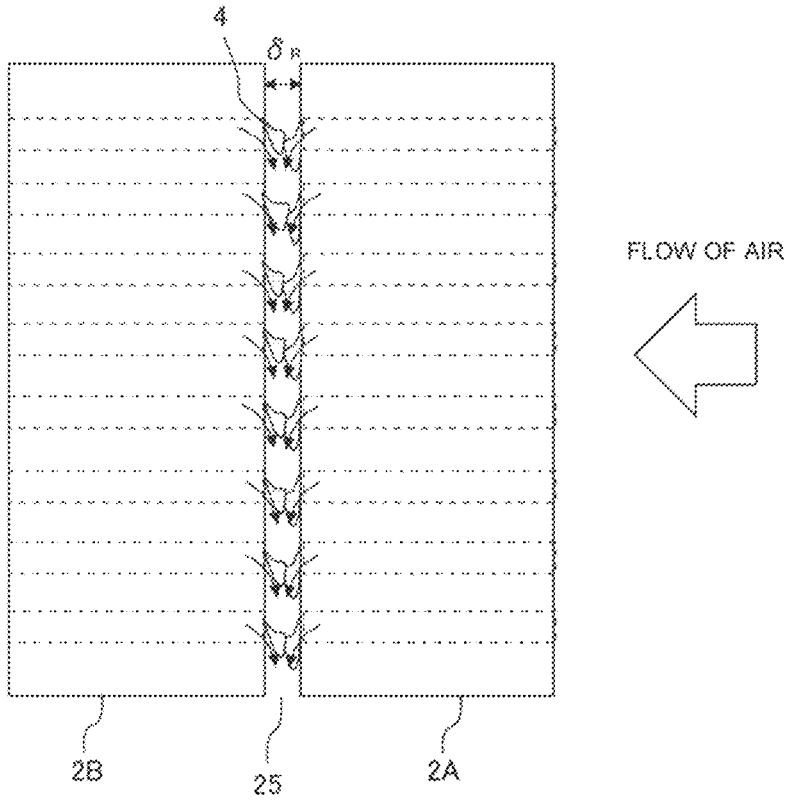
FIG. 5 is a schematic view illustrating a drainage phenomenon of condensed water in the heat exchanger according to Embodiment 1.

FIG. 5 is a schematic view illustrating a drainage phenomenon of condensed water in the heat exchanger according to Embodiment 1. FIG. 5 shows a side view of a relationship of a dimension $\delta_R$ in the direction of flow of the air of a drain space 25 between a corrugated fin 2A and a corrugated fin 2B. The dimension $\delta_R$ in the direction of flow of the air of the drain space 25 is described here. In FIG. 5, the drain space 25 satisfies such a dimension $\delta_R$ that the area ratio A2/A1 falls within the range of 0.03 to 0.40. In this case, as shown in FIG. 5, condensed water 4 at an end of the windward heat exchange module 11A and condensed water 4 at an end of the leeward heat exchange module 11B can merge by breaking the surface tension of the condensed water 4 in the drain space 25 between the heat exchange modules 11. This causes the merging condensed water 4 to flow down through the drain space 25 by gravity, further accelerating drainage.

Figure 6:
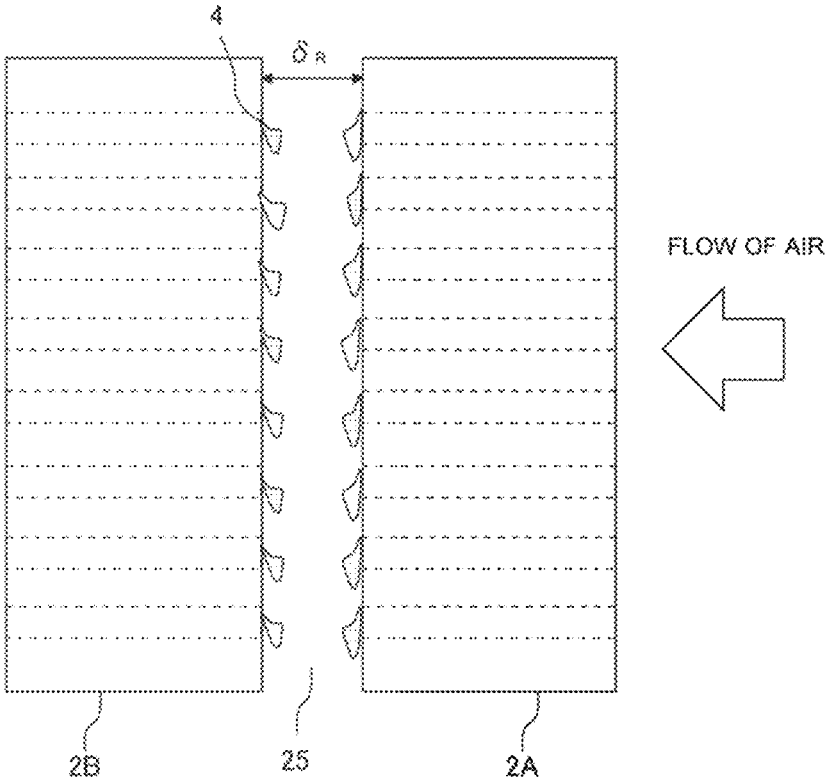
FIG. 6 is a schematic view illustrating a drainage phenomenon of condensed water in a case in which the opening area of a drain space is large.

FIG. 6 is a schematic view illustrating a drainage phenomenon of condensed water in a case in which the opening area of a drain space is large. If a dimension $\delta_R$ in the direction of flow of the air of a drain space 25 is wide, condensed water 4 is retained at ends of the fins by surface tension. For this reason, if the area ratio A2/A1 of the opening area A2 of the drain space 25 to the fin area A1 is greater than or equal to 0.40, a stream of condensed water 4 at a lowermost stream end of the windward corrugated fin 2A and a stream of condensed water 4 at an uppermost stream end of the leeward corrugated fin 2B hardly merge. This makes the drain space 25 unable to function as a drain path, causing a decrease in drainage performance.

Figure 7:
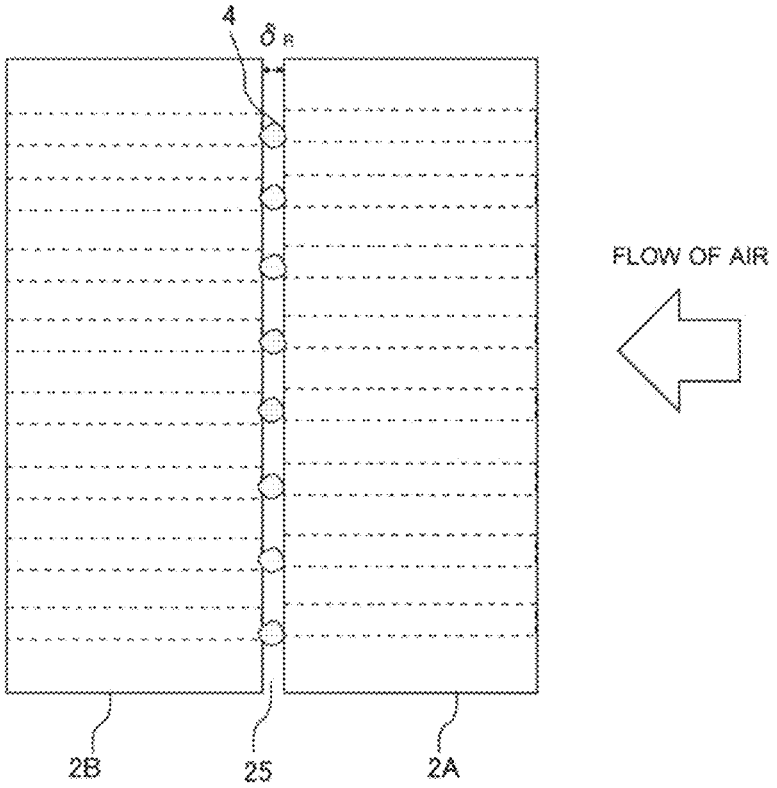
FIG. 7 is a schematic view illustrating a drainage phenomenon of condensed water in a case in which the opening area of a drain space is small.

FIG. 7 is a schematic view illustrating a drainage phenomenon of condensed water in a case in which the opening area of a drain space is small. A dimension $\delta_R$ in the direction of flow of the air of a drain space 25 may be so narrow that the opening area ratio of the drain space 25 is less than 0.03. In this case, if a lowermost stream end of the windward corrugated fin 2A and an uppermost stream end of the leeward corrugated fin 2B are too close to each other, condensed water 4 stays (forms bridges), so that there is a decrease in drainage performance.

As noted above, a heat exchanger 10 according to Embodiment 1 formed by a plurality of heat exchange modules 11 arranged in a direction of flow of air, for example, a louver 22A in a windward corrugated fin 2A and a louver 22B in a leeward corrugated fin 2B are made different in specification from each other. Moreover, the windward corrugated fin 2A is made lower in outside-tube heat transfer coefficient aO than the leeward corrugated fin 2B. This prevents closure of an airway in the corrugated fin 2A, making it possible to steer toward uniformity the amount of frost that forms on the whole heat exchanger 10. This makes it possible to increase the length of time it takes for an airway in the heat exchanger 10 to be completely closed by frost, and the heat exchanger 10 can have improved heating low-temperature capacity.

Further, the heat exchanger 10 according to Embodiment 1 is configured such that the opening area of the drain slit 24A in the windward corrugated fin 2A is larger than the opening area of the drain slit 24B in the leeward corrugated fin 2B. For this reason, the whole heat exchanger 10 can be expected to have improved drainage performance. This makes it possible to shorten the duration of defrosting operation time, making it possible to further improve heating low-temperature capacity.

Moreover, the heat exchanger 10 according to Embodiment 1 is configured such that the area ratio A2/A1 of the opening area A2 of a drain space 25, which is a gap between the heat exchange modules 11, to the fin area A1 of fin modules 21 falls within the range of 0.03 to 0.40. This allows the drain space 25 to function as a drain path, making it possible to improve the drainage performance of the whole heat exchanger 10.

Embodiment 2

Figure 8:
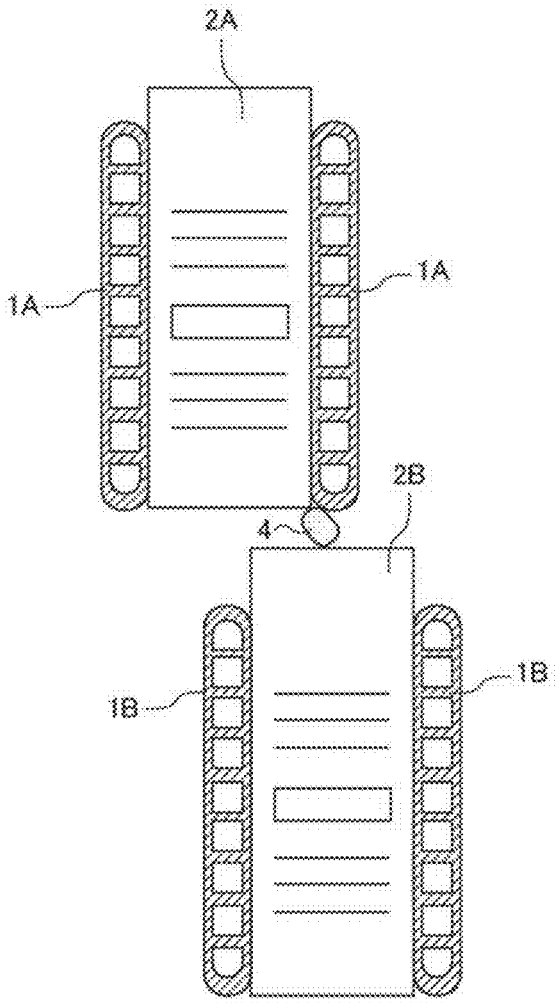
FIG. 8 is a schematic view showing part of a heat exchanger according to Embodiment 2 and a top view of part of the heat exchanger 10 as taken along a direction of flow of air.

FIG. 8 is a schematic view showing part of a heat exchanger according to Embodiment 2. FIG. 8 is a top view of part of the heat exchanger 10 as taken along a direction of flow of air. In FIG. 8, constituent elements given the same reference signs as those in FIG. 3 or other drawings are similar to those described in Embodiment 1. As shown in FIG. 8, the heat exchanger 10 according to Embodiment 2 is configured such that a windward flat heat-transfer tube 1A and a leeward heat transfer tube 1B are placed in different positions in a horizontal direction. Moreover, in the heat exchanger 10, a flat heat-transfer tube 1A of the windward heat exchange module 11A and a corrugated fin 2B of the leeward heat exchange module 11B are placed close to each other. Such placement allows condensed water 4 on the leeward corrugated fin 2B to be moved to the windward flat heat-transfer tube 1A. A flat heat-transfer tube 1 is higher in drainage performance than a corrugated fin 2. This makes it easy for condensed water 4 accumulated on the corrugated fin 2B to move to the flat heat-transfer tube 1A, thus bringing about improvement in drainage performance.

Figure 9:
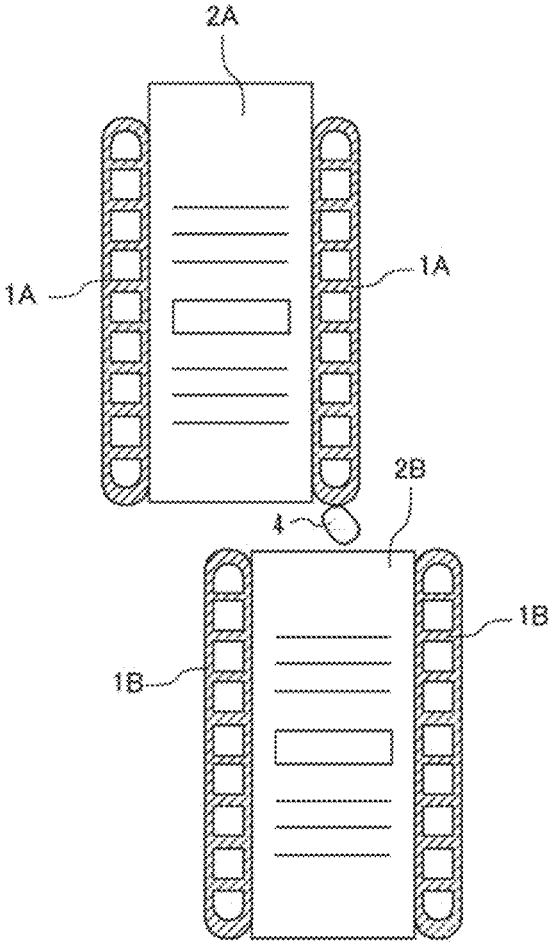
FIG. 9 is a schematic view showing part of another example of a heat exchanger according to Embodiment 2.

FIG. 9 is a schematic view showing part of another example of a heat exchanger according to Embodiment 2. As shown in FIG. 9, causing condensed water 4 on a windward corrugated fin 2A to be moved to a leeward flat heat-transfer tube 1B makes it possible to improve drainage performance. In this case, as shown in FIG. 9, if an uppermost stream end of a leeward corrugated fin 2B protrudes toward the windward side relative to the leeward flat heat-transfer tubes 1B to come close to a windward flat heat-transfer tube 1A, it becomes easy to transmit the condensed water 4 to the flat heat-transfer tube 1A.

Embodiment 3

Figure 10:
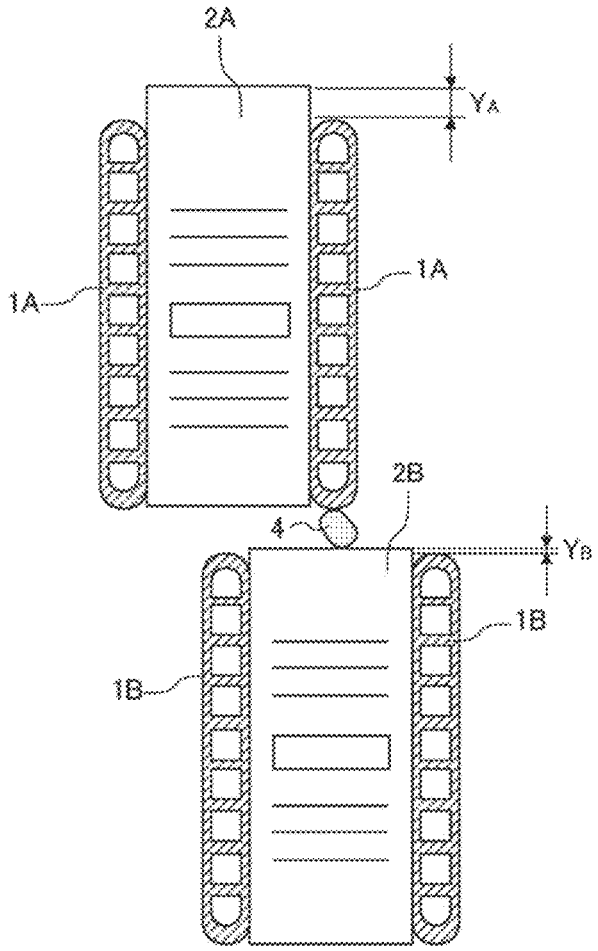
FIG. 10 is a schematic view showing part of a heat exchanger according to Embodiment 3.

FIG. 10 is a schematic view showing part of a heat exchanger according to Embodiment 3. FIG. 10 is a top view of part of the heat exchanger 10 as taken along a direction of flow of air. In FIG. 10, constituent elements given the same reference signs as those in FIG. 3 or other drawings are similar to those described in Embodiment 1. As shown in FIG. 10, the length of protrusion of a windward corrugated fin 2A in a windward direction relative to a flat heat-transfer tube 1A is defined as $y_A$. Further, the length of protrusion of a leeward corrugated fin 2B in the windward direction relative to a flat heat-transfer tube 1B is defined as $y_B$. The heat exchanger 10 according to Embodiment 3 is configured such that the lengths of protrusion of the corrugated fins 2A and 2B have a relationship $y_A > y_B$.

Causing the leading edge of a corrugated fin 2 to protrude toward the windward side makes it possible to reduce fin efficiency in a fin leading edge portion and reduce the amount of heat that is exchanged with the air, bringing about an effect of inhibiting a disproportionately large amount of frost from forming on the corrugated fin leading edge portion. However, the leeward corrugated fin 2B is smaller in temperature difference between the air and the refrigerant than the windward corrugated fin 2A. For this reason, the leeward corrugated fin 2B tends to be small in the amount of heat that is exchanged. As a result of this, the leeward heat exchange module 11B tends to be smaller in the amount of frost that forms. Accordingly, the heat exchanger 10 according to Embodiment 3 is configured such that the length ye of protrusion of the fin leading edge portion of the leeward corrugated fin 2B toward the windward side is smaller than the length $y_A$ of protrusion of the windward corrugated fin 2A. Moreover, the leeward corrugate fin 2B enhances heat transfer, for example, by having many louvers 22.

Figure 11:
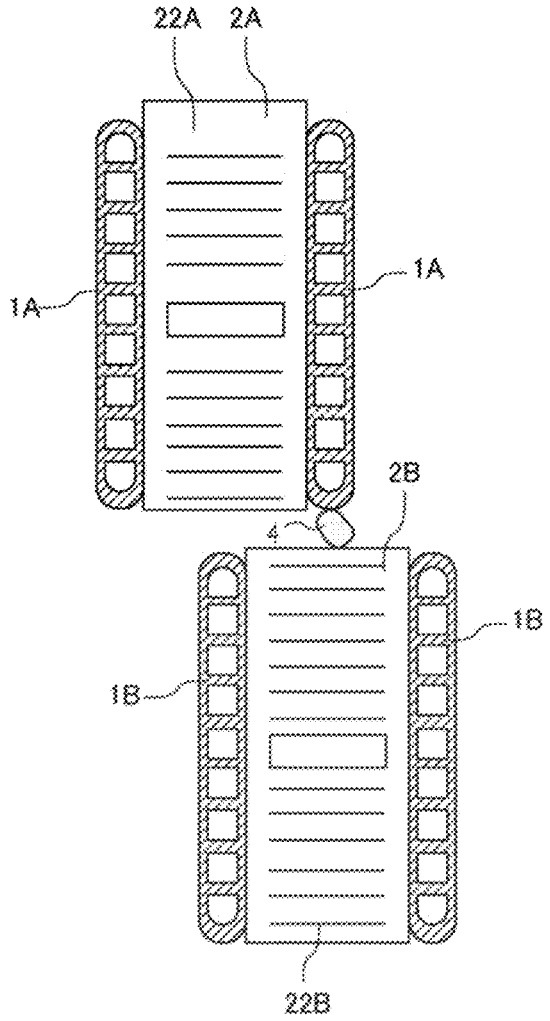
FIG. 11 is a schematic view showing part of another example of a heat exchanger according to Embodiment 3.

FIG. 11 is a schematic view showing part of another example of a heat exchanger according to Embodiment 3. The heat exchanger 10 shown in FIG. 11 is configured such that the length of protrusion of the leading edge portion of a leeward corrugated fin 2B is shorter than that of a windward corrugated fin 2A. In the configuration shown in FIG. 11, the number of louvers 22B of the leeward corrugated fin 2B is larger than that of the windward corrugated fin 2A.

Figure 12:
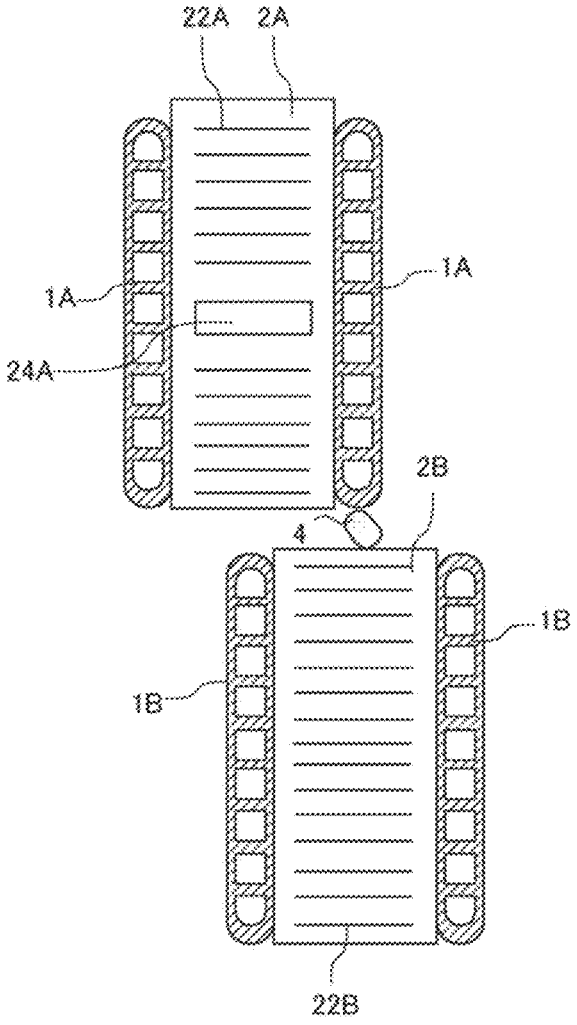
FIG. 12 is a schematic view showing part of still another example of a heat exchanger according to Embodiment 3.

FIG. 12 is a schematic view showing part of still another example of a heat exchanger according to Embodiment 3. The heat exchanger 10 shown in FIG. 12 is configured such that while a windward corrugated fin 2A has a drain slit 24A, a leeward corrugated fin 2B has no drain slit 24. Moreover, setting up a configuration in which the number of louvers 22 of the leeward corrugated fin 2B is larger than that of the windward corrugated fin 2A makes it possible to drain condensed water 4 through the louvers 22B even without a drain slit 24. For this reason, the heat exchanger 10 of FIG. 12 can bring about well-balanced improvement in heat-transfer performance and drainage performance.

Embodiment 4

Figure 13:
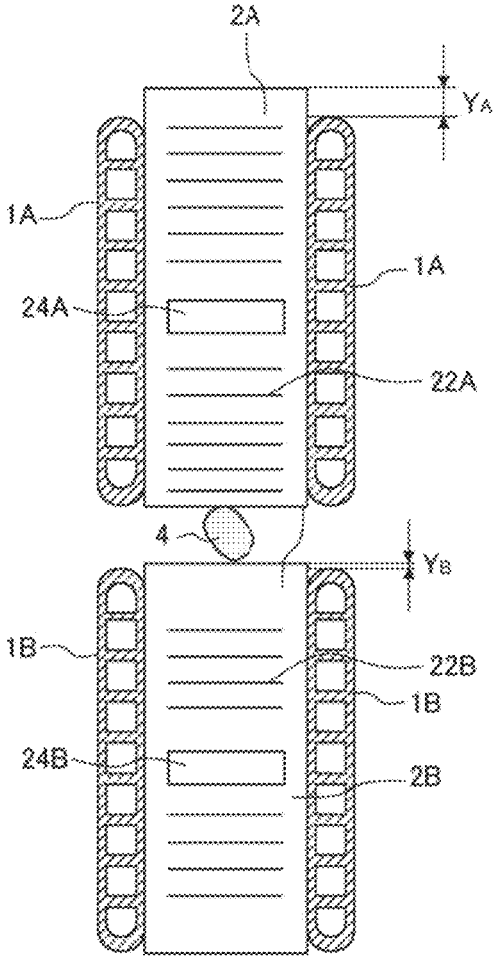
FIG. 13 is a schematic view showing part of a heat exchanger according to Embodiment 4.
Figure 14:
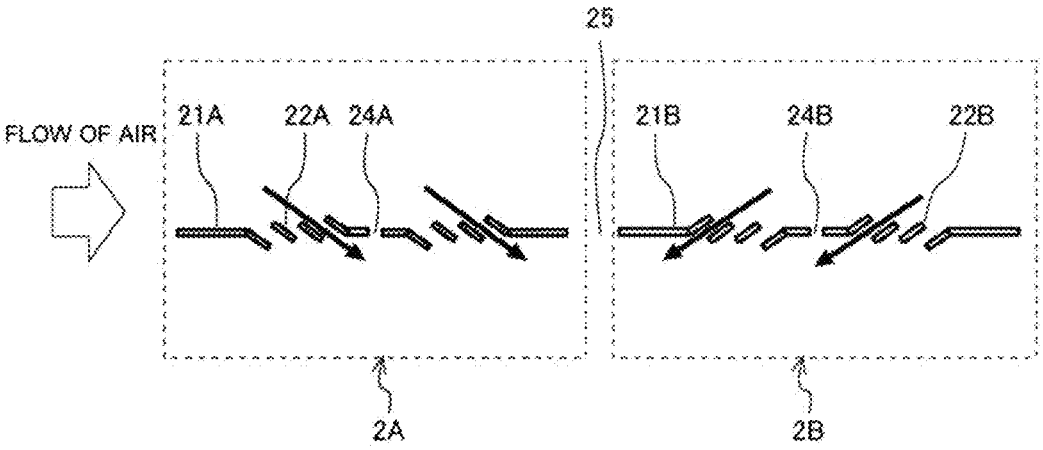
FIG. 14 is a schematic view of corrugated fins of the heat exchanger of Embodiment 4 as seen from the side.

FIG. 13 is a schematic view showing part of a heat exchanger according to Embodiment 4. FIG. 13 is a top view of part of the heat exchanger 10 as taken along a direction of flow of air. FIG. 14 is a schematic view of corrugated fins of the heat exchanger of Embodiment 4 as seen from the side. FIG. 14 shows a fin module 21A of a corrugated fin 2A and a fin module 21B of a corrugated fin 2B. In FIG. 14, the white arrow indicates the direction of flow of the air. Further, the black arrows illustrate an image of drainage of condensed water 4. In FIGS. 13 and 14, constituent elements given the same reference signs as those in FIG. 3 or other drawings are similar to those described in Embodiment 1. The heat exchanger 10 according to Embodiment 4 includes the aforementioned drain space 25 between a windward corrugated fin 2A and a leeward corrugated fin 2B. Furthermore, the heat exchanger 10 according to Embodiment 4 is configured such that windward louvers 22A and leeward louvers 22B are opposite in opening direction of louvers 22 relative to flat portions. Moreover, in the configuration, the windward louvers 22A and the leeward louvers 22B are inclined toward the drain space 25.

In the heat exchanger 10 according to Embodiment 4, the configuration, the windward louvers 22A and the leeward louvers 22B are opposite in opening direction of louvers 22 to each other so that condensed water 4 moves toward the drain space 25 between the heat exchange modules 11. This makes it possible to collect a lot of condensed water 4 in the drain space 25, making it possible to improve drainage performance.

Embodiment 5

Figure 15:
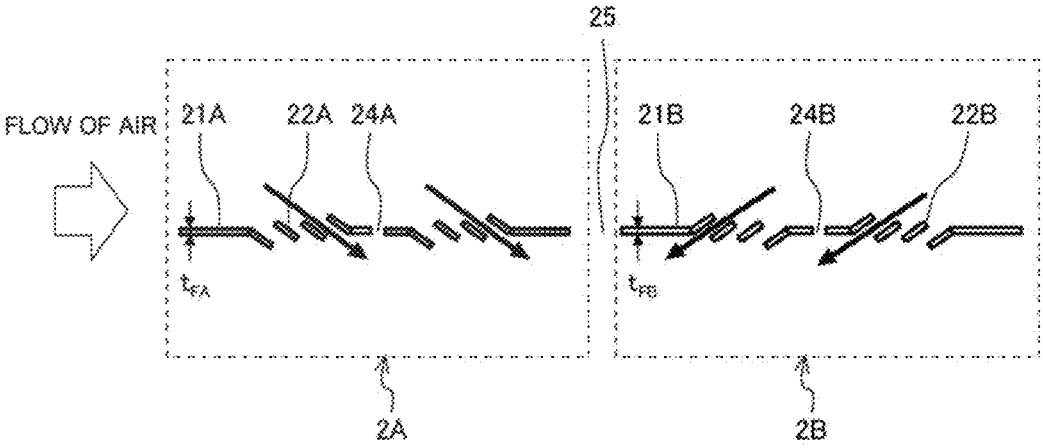
FIG. 15 is a schematic view of corrugated fins of a heat exchanger of Embodiment 5 as seen from the side.

FIG. 15 is a schematic view of corrugated fins of a heat exchanger of Embodiment 5 as seen from the side. In FIG. 15, constituent elements given the same reference signs as those in FIG. 3 or other drawings are similar to those described in Embodiment 1. FIG. 15 shows a fin module 21A of a corrugated fin 2A and a fin module 21B of a corrugated fin 2B. In the heat exchanger 10 according to Embodiment 5, the fin thickness of the windward corrugated fin 2A is defined as $t_{FA}$. Further, the fin thickness of the leeward corrugated fin 2B is defined as $t_{FB}$. In this case, the fin thicknesses of the corrugated fins 2A and 2B have a relationship $t_{FA}<t_{FB}$. Accordingly, the heat exchanger 10 according to Embodiment 5 is configured such that the fin thickness $t_{FA}$ of the windward corrugated fin 2A is smaller than the fin thickness $t_{FB}$ of the leeward corrugated fin 2B.

In the windward heat exchange module 11A, the temperature difference between the air and the refrigerant is great, as the air flows into the windward heat exchange module 11A before exchanging heat. Reducing the fin thickness $t_{FA}$ of the windward corrugated fin 2A makes it possible to reduce fin efficiency on the windward corrugated fin 2A, making it possible to reduce the outside-tube heat transfer coefficient aO. This makes it possible to further inhibit a disproportionately large amount of frost from forming on the windward heat exchange module 11A.

Embodiment 6

Figure 16:
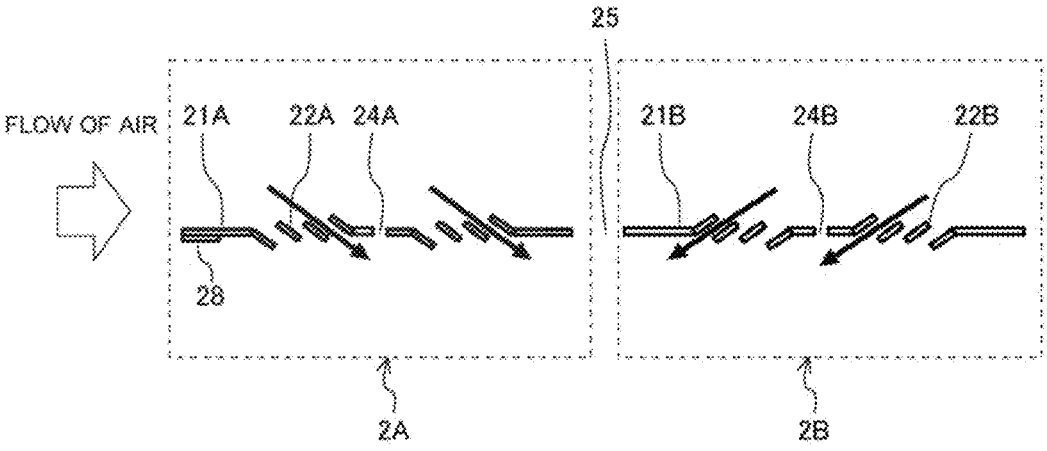
FIG. 16 is a schematic view of corrugated fins of a heat exchanger of Embodiment 6 as seen from the side.

FIG. 16 is a schematic view of corrugated fins of a heat exchanger of Embodiment 6 as seen from the side. In FIG. 16, constituent elements given the same reference signs as those in FIG. 3 or other drawings are similar to those described in Embodiment 1. FIG. 16 shows a fin module 21A of a corrugated fin 2A and a fin module 21B of a corrugated fin 2B. The heat exchanger 10 according to Embodiment 6 is structured to have, in part of a leading edge protruding portion of the windward corrugated fin 2A, an edge folded portion 28 formed by folding a fin material. The structure in which the corrugated fin 2A has the edge folded portion 28 in the leading edge protruding portion makes it possible to substantially double the fin thickness of the leading edge protruding portion, which requires strength. For this reason, the heat exchanger 10 according to Embodiment 6 makes it possible to reduce fallen fins or other defects and reduce the fin thicknesses of other portions. This makes it possible to reduce fin efficiency and reduce the outside-tube heat transfer coefficient aO, making it possible to further inhibit a disproportionately large amount of frost from forming on the windward corrugated fin 2A. Although the heat exchanger 10 of FIG. 16 is structured to have the edge folded portion 28 in the leading edge protruding portion of the windward corrugated fin 2A, this is not intended to impose any limitation.

Figure 17:
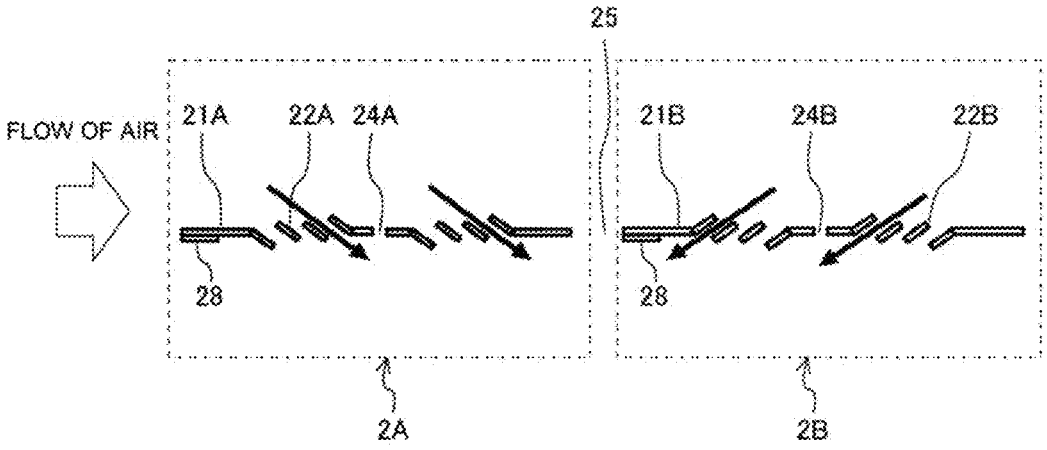
FIG. 17 is a schematic view of corrugated fins of another example of a heat exchanger of Embodiment 6 as seen from the side.

FIG. 17 is a schematic view of corrugated fins of another example of a heat exchanger of Embodiment 6 as seen from the side. For example, as shown in FIG. 17, the heat exchanger 10 may be structured to have edge folded portions 28 in the leading edge portions of both a windward corrugated fin 2A and a leeward corrugated fin 2B. Having the edge folded portions 28 in both the windward corrugated fin 2A and the leeward corrugated fin 2B makes it possible to inhibit a disproportionately large amount of frost from forming on both the windward corrugated fin 2A and the leeward corrugated fin 2B.

Figure 18:
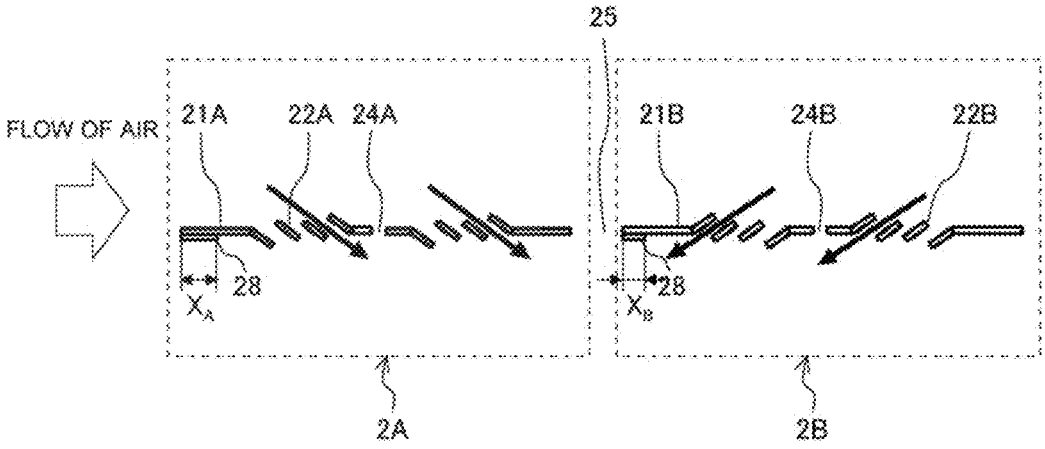
FIG. 18 is a schematic view of corrugated fins of still another example of a heat exchanger of Embodiment 6 as seen from the side.

FIG. 18 is a schematic view of corrugated fins of still another example of a heat exchanger of Embodiment 6 as seen from the side. In the heat exchanger 10 of FIG. 18, the length of an edge folded portion 28 in the leading edge protruding portion of a windward corrugated fin 2A is defined as $X_A$. Further, the length of an edge folded portion 28 in the leading edge protruding portion of a leeward corrugated fin 2B is defined as $X_B$. In this case, the lengths of the edge folded portions 28 of the corrugated fins 2A and 2B have a relationship $X_A>X_B$. For this reason, the length of leading edge protrusion of the windward corrugated fin 2A is longer than the length of leading edge protrusion than the leeward corrugated fin 2B. In this case, it is preferable, in terms of cost effectiveness, that the lengths of the edge folded portions 28 match the lengths of leading edge protrusion. Accordingly, adjusting the lengths of the edge folded portions 28 in the corrugated fins 2A and 2B allows the edge folded portions 28 to have smaller sizes with appropriate strength. This makes it possible to use less fin material.

Figure 19:
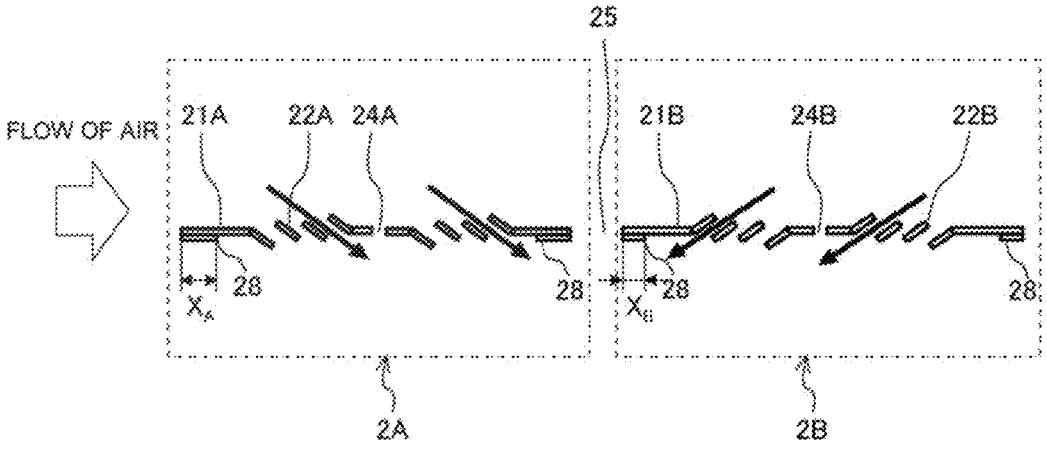
FIG. 19 is a schematic view of corrugated fins of still another example of a heat exchanger of Embodiment 6 as seen from the side.

FIG. 19 is a schematic view of corrugated fins of still another example of a heat exchanger of Embodiment 6 as seen from the side. Although each of the heat exchangers 10 shown in FIGS. 16 to 18 is structured such that an edge folded portion 28 is provided in only the leading edge portion of a corrugated fin, this is not intended to impose any limitation. As shown in FIG. 19, the heat exchanger 10 may be structured to also have an edge folded portion 28 at a trailing edge portion that is backward in a direction of flow of air. Such a structure as that shown in FIG. 19 makes it possible to, in folding a fin material during the manufacture of a corrugated fin 2, make both ends of the fin material the same in height. This stabilizes the feeding of the fin material in moving the fin material with rollers, making accurate processing possible.

Embodiment 7

Figure 20:
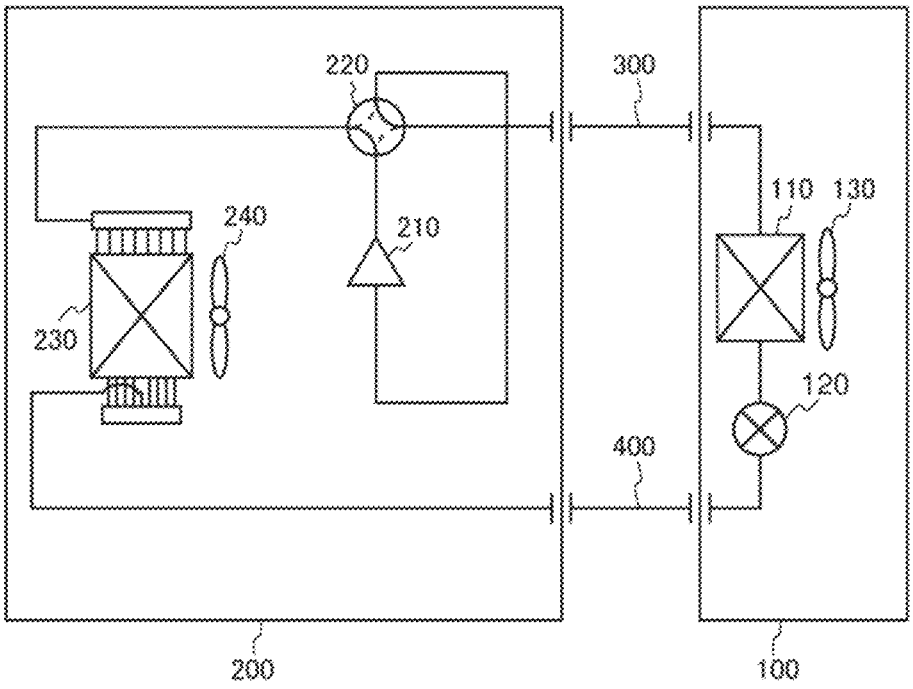
FIG. 20 is a diagram showing a configuration of an air-conditioning apparatus according to Embodiment 7.

FIG. 20 is a diagram showing a configuration of an air-conditioning apparatus according to Embodiment 7. The air-conditioning apparatus of Embodiment 7 is an example of a refrigeration cycle apparatus including a heat exchanger 10 of any of Embodiments 1 to 6. The air-conditioning apparatus of Embodiment 7 uses a heat exchanger 10 of any of Embodiments 1 to 6 as an outdoor heat exchanger 230. Note, however, that this is not intended to impose any limitation. The air-conditioning apparatus may use a heat exchanger 10 of any of Embodiments 1 to 6 as an indoor heat exchanger 110. Further, the air-conditioning apparatus may use heat exchangers 10 of any of Embodiments 1 to 6 as both the outdoor heat exchanger 230 and the indoor heat exchanger 110.

As shown in FIG. 20, the air-conditioning apparatus constitutes a refrigerant circuit by connecting an outdoor unit 200 and an indoor unit 100 with a gas refrigerant pipe 300 and a liquid refrigerant pipe 400. Although it is assumed that one outdoor unit 200 and one indoor unit 100 are connected by pipes in the air-conditioning apparatus of Embodiment 7, the numbers are arbitrary.

The outdoor unit 200 includes a compressor 210, a four-way valve 220, the outdoor heat exchanger 230, and an outdoor fan 240. The compressor 210 compresses and discharges refrigerant suctioned thereinto. Although not limited in particular, the compressor 210 can change the capacity of the compressor 210 by arbitrarily varying the operating frequency, for example, through an inverter circuit or other circuits. The four-way valve 220 is a valve configured to switch the flow of refrigerant between cooling operation and heating operation. The outdoor heat exchanger 230 exchanges heat between refrigerant and outdoor air. During heating operation, the outdoor heat exchanger 230 functions as an evaporator to evaporate and gasify the refrigerant. Further, during cooling operation, the outdoor heat exchanger 230 functions as a condenser to condense and liquefy the refrigerant. The outdoor fan 240 sends the outdoor air into the outdoor heat exchanger 230 and facilitates heat exchange in the outdoor heat exchanger 230.

Meanwhile, the indoor unit 100 includes the indoor heat exchanger 110, a pressure reducing device 120, and an indoor fan 130. The indoor heat exchanger 110 exchanges heat between air in a room to be air-conditioned and refrigerant. During heating operation, the indoor heat exchanger 110 functions as a condenser to condense and liquefy the refrigerant. Further, during cooling operation, the indoor heat exchanger 110 functions as an evaporator to evaporate and gasify the refrigerant. The pressure reducing device 120 decompresses and expands the refrigerant. The pressure reducing device 120 is constituted, for example, by an electronic expansion valve or other devices. In a case in which the pressure reducing device 120 is constituted by an electronic expansion valve, the pressure reducing device 120 adjusts its opening degree in accordance with an instruction from a controller (not illustrated) or other devices. The indoor fan 130 passes the air in the room through the indoor heat exchanger 110 and supplies into the room the air passed through the indoor heat exchanger 110.

Next, the actions of the pieces of equipment of the air-conditioning apparatus are described with reference to the flow of refrigerant. First, heating operation is described. During heating operation, the four-way valve 220 is switched to a dotted line side of FIG. 20. High-temperature and high-pressure gas refrigerant compressed and discharged by the compressor 210 passes through the four-way valve 220 and flows into the indoor heat exchanger 110. The gas refrigerant flowing into the indoor heat exchanger 110 condenses and liquefies by exchanging heat with air in a space to be air-conditioned. The refrigerant thus liquefied is decompressed by the pressure reducing device 120 into two-phase gas-liquid refrigerant that then flows into the outdoor heat exchanger 230. The refrigerant flowing into the outdoor heat exchanger 230 evaporates and gasifies by exchanging heat with outdoor air sent from the outdoor fan 240. The refrigerant thus gasified passes through the four-way valve 220 and is suctioned again into the compressor 210. Such circulation of the refrigerant causes the air-conditioning apparatus to perform air conditioning related to heating.

Next, cooling operation is described. During cooling operation, the four-way valve 220 is switched to a solid line side of FIG. 20. High-temperature and high-pressure gas refrigerant compressed and discharged by the compressor 210 passes through the four-way valve 220 and flows into the outdoor heat exchanger 230. he gas refrigerant flowing into the outdoor heat exchanger 230 condenses and liquefies by exchanging heat with outdoor air supplied by the outdoor fan 240. The refrigerant thus liquefied is decompressed by the pressure reducing device 120 into two-phase gas-liquid refrigerant that then flows into the indoor heat exchanger 110. The refrigerant flowing into the indoor heat exchanger 110 evaporates and gasifies by exchanging heat with air in the space to be air-conditioned. The refrigerant thus gasified passes through the four-way valve 220 and is suctioned again into the compressor 210. Such circulation of the refrigerant causes the air-conditioning apparatus to perform air conditioning related to cooling.

REFERENCE SIGNS LIST

1, 1A, 1B: flat heat-transfer tube, 2, 2A, 2B: corrugated fin, 3, 3A, 3B: header, 4: condensed water, 10: heat exchanger, 11: heat exchange module, 11A: windward heat exchange module, 11B: leeward heat exchange module, 21, 21A, 21B: fin module, 22, 22A, 22B: louver, 24, 24A, 24B: drain slit, 25: drain space, 28: edge folded portion, 31, 31A, 31B: upper header, 32, 32A, 32B: lower header, 33, 33A, 33B: inflow pipe, 34, 34A, 34B: outflow pipe, 100: indoor unit, 110: indoor heat exchanger, 120: pressure reducing device, 130: indoor fan, 200: outdoor unit, 210: compressor, 220: four-way valve, 230: outdoor heat exchanger, 240: outdoor fan, 300: gas refrigerant pipe, 400: liquid refrigerant pipe

The invention claimed is:

1. A heat exchanger comprising:

a plurality of heat exchange modules arranged with spacing from one another along a direction of flow of air, wherein each of the plurality of heat exchange modules includes a pair of headers through which a fluid passes, the two headers being placed at a distance from each other in an up-down direction, a plurality of flat heat-transfer tubes each having a flat shape in cross-section, being placed between the two headers such that a flat surface of a long side of the flat shape of each of the flat heat-transfer tubes and a flat surface of a long side of the flat shape of another of the flat heat-transfer tubes face each other with spacing from one another, and each having therein flow passages through which the fluid flows, and a plurality of corrugated fins each having a corrugated shape and being each placed between ones of the flat heat-transfer tubes that face each other, the corrugated shape having apices joined to the flat heat-transfer tubes, the plurality of corrugated fins each including fin modules between the apices, the fin modules being arranged in the up-down direction, one of the corrugated fins situated on a leeward side in the direction of flow of the air is higher in outside-tube heat transfer coefficient than is one of the corrugated fins situated on a windward side in the direction of flow of the air, and when, in the direction of flow of the air, a length of protrusion of the corrugated fin situated on the windward side in a windward direction relative to a corresponding one of the flat heat-transfer tubes is defined as ya and a length of protrusion of the corrugated fin situated on the leeward side in the windward direction relative to a corresponding one of the flat heat-transfer tubes is defined as $y_B$, a relationship $y_A>y_B$ holds.

2. The heat exchanger of claim 1, wherein each of the fin modules of each of the corrugated fins includes:

a plate-shaped flat portion, and a louver having a plate portion protruding at an inclination in the up-down direction relative to the flat portion when the corrugated fin is seen in a front view from the direction of flow of the air, the louver being configured to change the flow of the air by causing the air to pass through an opening.

3. The heat exchanger of claim 1, wherein when an area of the fin modules in a top view of the corrugated fins is defined as A1 and an opening area of a drain space between the heat exchange modules is defined as A2, an area ratio A2/A1 of the opening area A2 of the drain space to the area A1 of the fin modules is a relationship that satisfies 0.03 or higher and 0.40 or lower.

4. The heat exchanger of claim 1, wherein the fin modules of the corrugated fins have drain slits through which water on the fin modules is drained, and the drain slit in the fin module of the corrugated fin situated on the leeward side is smaller in opening area than the drain slit in the fin module of the corrugated fin situated on the windward side or the fin module of the corrugated fin situated on the leeward side does not have the drain slit.

5. The heat exchanger of claim 1, wherein a number of louvers in the corrugated fin situated on the windward side is smaller than a number of louvers in the corrugated fin situated on the leeward side.

6. The heat exchanger of claim 1, wherein the corrugated fin situated on the windward side and the corrugated fin situated on the leeward side are opposite in louver orientation to each other relative to a plate-shaped flat portion of each of the fin modules.

7. The heat exchanger of claim 1, wherein a thickness of the corrugated fin situated on the windward side is smaller than a thickness of the corrugated fin situated on the leeward side.

8. The heat exchanger of claim 1, wherein the corrugated fin situated on the windward side is structured such that a leading edge portion serving as an edge that is forward in the direction of flow of the air protrudes toward the windward side relative to a corresponding one of the flat heat-transfer tubes, and part of the leading edge portion has an edge folded portion formed by folding a fin material.

9. The heat exchanger of claim 8, wherein the corrugated fin situated on the leeward side also has the edge folded portion in part of the leading edge portion, and when a length of the edge folded portion of the corrugated fin situated on the windward side is defined as $X_A$ and a length of the edge folded portion of the corrugated fin situated on the leeward side is defined as $X_B$, a relationship $X_A>X_B$ holds.

10. The heat exchanger of claim 8, wherein each of the corrugated fins also has an edge folded portion in a trailing edge portion serving as an edge that is backward in the direction of flow of the air.

11. The heat exchanger of claim 1, wherein when seen in a front view from the direction of flow of the air, the flat heat-transfer tubes of one of the heat exchange modules situated on the windward side and the flat heat-transfer tubes of one of the heat exchange modules situated on the leeward side are displaced from each other in a horizontal direction.

12. A refrigeration cycle apparatus comprising the heat exchanger of claim 1.

13. The heat exchanger of claim 2, wherein when an area of the fin modules in a top view of the corrugated fins is defined as A1 and an opening area of a drain space between the heat exchange modules is defined as A2, an area ratio A2/A1 of the opening area A2 of the drain space to the area A1 of the fin modules is a relationship that satisfies 0.03 or higher and 0.40 or lower.

14. The heat exchanger of claim 2, wherein the fin modules of the corrugated fins have drain slits through which water on the fin modules is drained, and the drain slit in the fin module of the corrugated fin situated on the leeward side is smaller in opening area than the drain slit in the fin module of the corrugated fin situated on the windward side or the fin module of the corrugated fin situated on the leeward side does not have the drain slit.

15. The heat exchanger of claim 3, wherein the fin modules of the corrugated fins have drain slits through which water on the fin modules is drained, and the drain slit in the fin module of the corrugated fin situated on the leeward side is smaller in opening area than the drain slit in the fin module of the corrugated fin situated on the windward side or the fin module of the corrugated fin situated on the leeward side does not have the drain slit.

* * * * *